United States Patent [19]

Deuber et al.

[11] Patent Number: 4,646,692

[45] Date of Patent: Mar. 3, 1987

[54] COMPONENT FOR INTERNAL COMBUSTION ENGINES AND A PROCESS FOR ITS PRODUCTION

[75] Inventors: Andreas Deuber, Nürnberg; Edmund Siegl, Grosshabersdorf, both of Fed. Rep. of Germany

[73] Assignee: Alcan Aluminiumwerk Nürnberg GmbH, Nürnberg, Fed. Rep. of Germany

[21] Appl. No.: 734,867

[22] Filed: May 16, 1985

[30] Foreign Application Priority Data

Jun. 1, 1984 [DE] Fed. Rep. of Germany ..... 3420571

[51] Int. Cl.[4] ..... F02B 75/08

[52] U.S. Cl. ..... 123/193 P; 123/669; 123/193 H

[58] Field of Search ..... 123/193 R, 193 P, 41.35, 123/657, 668, 669, 193 H

[56] References Cited

U.S. PATENT DOCUMENTS

| | | | |
|---|---|---|---|
| 4,018,194 | 4/1977 | Mitchell et al. | 123/41.35 |
| 4,245,611 | 1/1981 | Mitchell et al. | 123/193 P |
| 4,494,501 | 1/1985 | Ludovico | 123/669 |
| 4,530,341 | 7/1985 | Palm | 123/193 P |

FOREIGN PATENT DOCUMENTS

| | | | |
|---|---|---|---|
| 2541966 | 3/1977 | Fed. Rep. of Germany | 123/41.35 |
| 160790 | 12/1921 | United Kingdom | 123/193 P |
| 2092709 | 8/1982 | United Kingdom | 123/193 P |

*Primary Examiner*—Craig R. Feinberg
*Attorney, Agent, or Firm*—Cooper, Dunham, Griffin & Moran

[57] ABSTRACT

The invention concerns components for internal combustion engines with heat resistant combustion chamber inserts, especially components made of light metal with casted porous ceramic inserts positioned by casting around the basic material, in which in order to lower the gas pressure which builds up under said inserts (3), at least one gas pressure release bore hole (4,5) is provided in the basic material of the component (1) which leads to the bottom of said insert. The invention further describes a process for the production of these components in which the insert is first fixed in its position relative to the basic element and thereafter the bore holes are produced in the basic material.

4 Claims, 2 Drawing Figures

COMPONENT FOR INTERNAL COMBUSTION ENGINES AND A PROCESS FOR ITS PRODUCTION

Figure 1:
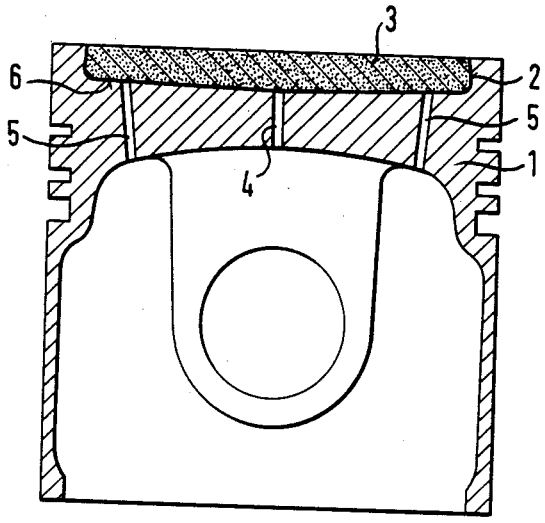

The invention concerns a combustion chamber component for internal combustion engines comprising at least one insert of a heat resistant, especially a ceramic material, this insert being arranged in a recess, which faces the combustion chamber, and being bound with the basic material of said component by casting around or by shrinking.

Components of aluminum alloys which define the combustion chamber of internal combustion engines are often provided with inserts of material having great heat resistance and mechanical strength in order to locally armour the light metal material in thermally and/or mechanically highly stressed areas. A typical example are the combustion chamber inserts in pistons. Similar inserts are also used in cylinder heads. The inserts may consist of heat resistant steels or of other suitable heavy metal alloys. Recently preference has been given to the use of ceramic materials for this purpose.

Especially when using ceramic inserts there is the technical problem, which has not yet been satisfactorily solved, of giving the insert a firm position in the basic material of the piston.

In German Pat. No. 725 761 pistons are described in which the inserts are positively anchored in the basic material of the piston by undercuts upon casting around. Due to the shrinking of the cast material however, stress concentrations arise in the area of said undercuts, which may easily lead to cracks in the ceramic insert. In addition there is often not enough space available for an undercut on the piston head for purely constructional reasons.

The same danger of inadmissible stresses in the ceramic material also exists in the case of mechanical connections, e.g. by means of screws. The buffering of the shrinkage stresses with soft interlays such as is described in U.S. Pat. No. 4,245,611 does not produce a solution which is satisfactory in every respect either.

The connection technology which is most favorable with respect to the required space and the avoidance of stress concentrations is the clamping of the ceramic insert substantially by the shrinkage forces which arise during casting in providing a smooth and at most slightly curved outer surface of the insert part.

In order to achieve a secured position of the molded part even under motor operating conditions solely by means of the shrinkage stress which arises during casting around, it is necessary to coordinate the relevant physical properties, such as the coefficient of expansion, the elasticity modulus and the flow limit of the materials being used so that sufficient shrinkage forces remain even in the case of cyclical temperature changes, as is described in DE-OS No. 33 28 435.

Despite such measures experience has shown that the insert parts which are cast around in this way gradually crept out of the enveloping cast material during motor operation, whereby it might easily happen that the ceramic part impacts against the opposite parts of the combustion chamber wall and that thus the insert is destroyed. It was interesting that the insert part, even in the partially emerged state, was as a rule still firmly held by shrinkage forces.

The object of the invention is to develop components of the type named above in which the inserts do not creep out during the operation of the motor from the enclosing basic material, and thus they possess a permanently fixed position in the basic material of the component. Further the object is to describe a process for the production of these components.

This object is solved by components having the features of claim 1 and by a process as described in claim 5.

Accordingly at least one gas pressure release bore hole is provided in the basic material leading to the bottom of the inserts for the release of gas pressure which builds up below said inserts. These bore holes which according to the invention may have a diameter of from 0.01 to 10 mm take effect as vents or pressure release channels, i.e. they prevent the build-up of a gas pressure cushion in the joint face between the insert part and the surrounding cast material.

According to the process proposed by the invention, the insert is firstly fixed in the correspondingly prepared component or in the mold cavity of the casting mold for the component in its position relative to the other component, and only thereafter the release bore holes are produced in the basic material of the component by suitable measures during the casting and by mechanical processing. The anchoring of the insert in the basic material is done expediently by casting around and/or by shrinkage. In the case of inserts made of ceramic materials pressing is almost excluded as a connecting process, because a ceramic body would not withstand, probably, the mechanical loading.

The invention which concerns preferably inserts of porous ceramic material is based on the following knowledge and/or considerations:

After casting around there is a certain amount of enclosed gas or of condensed gasifiable substances such as water, for example, in the joint face between the insert and the cast around material. These substances may be inclusions of air which has not wholly escaped from the mold cavity on the one hand; on the other hand they may stem from the fact that ceramic parts have by their very nature a certain inevitable porosity, which has the result that they separate gases over lengthy periods when heated. In addition there is often, also over lengthy periods, a continuing splitting off of crystal water from the ceramic material. Under the influence of the high motor operating temperature, the encapsuled gases or gasifiable substances expand and drive the insert outwards like a pneumatic piston.

A further process can be superimposed thereon. During the heating when the motor is operating the piston does not expand completely evenly, so that there may be a slight uncircularity and local fissure formations between the cast around material and the insert. The combustion gases which are under high pressure then penetrate along these gaps in the joint face between the cast around material and the insert. When the outlet valve is opened the gas pressure in the combustion chamber drops in a very short period, whereas the gas which has penetrated into the joint face can only escape slowly so that on every working stroke there is for a certain time an over-pressure in the joint face which wants to force the insert outwards. With the progressive outward creep the gas volume in the joint face will increase and will correspondingly accelerate the process.

The pressure release bore holes which are provided according to the invention prevent the build-up of an over-pressure in the joint face and thus they prevent the process described above of the forcing out of the insert. The pressure of the combustion gases which now takes effect only on the one side of the combustion chamber, when the pressure release bore holes are present, will constantly press the insert into its deepest position or into its position, which it obtained by casting around the basic material.

Though there are known already pistons which are provided with bore holes in the basic material open towards the joint face between the basic material and the insert. These bore holes have totally different functions.

Thus DE-OS No. 31 10 292 shows a piston with ceramic insert which has a bore hole in the base of the piston head recess and which leads from the joint face between the insert part and the piston head into the interior of the piston. But this is not a cast around insert part, it is a part which is inserted purely mechanically in the piston head after the casting thereof, which serves as bore hole for the lubricating oil.

Further in the PCT application WO No. 83/00535 a piston is described with a heat resistant metallic insert in the area of the combustion chamber in which a centric bore hole is provided in the base of the piston head recess. But this bore hole only serves to allow the air to escape during the pressing of the insert into the recess in the piston head. It is not intended for venting during the operation of the motor. Recesses are provided namely in the base of the piston head cut out or in the base of the insert, which serve to reduce the surface contact between the insert and the basic material. But these recesses are not equipped with bore holes, although they form gas cushions. Moreover, ceramic inserts, as was mentioned above, cannot be introduced by pressing. They must be inserted by casting around or possibly shrunk in. Neither casting nor shrinking however would cause the expert to install a ventilation bore hole such as that in the case of the piston in question.

According to the invention it is certainly possible to provide a release bore hole which is substantially central. But since the greatest mechanical stresses arise in the centre of the piston base it is preferred to provide a plurality of bore holes for venting purposes which are positioned off-center. With a large number of peripherally disposed bore holes of small cross section a relatively large ventilating cross section is created in the area where the gases enter during the motor operation into the space between the insert and the piston base. Thereby at the same time a weakening of the piston by a too large central bore is avoided.

The subject of the invention will be further described with reference to embodiments which are shown in the drawings.

These show:

FIG. 1—an inventive component in form of a piston and

Figure 2:
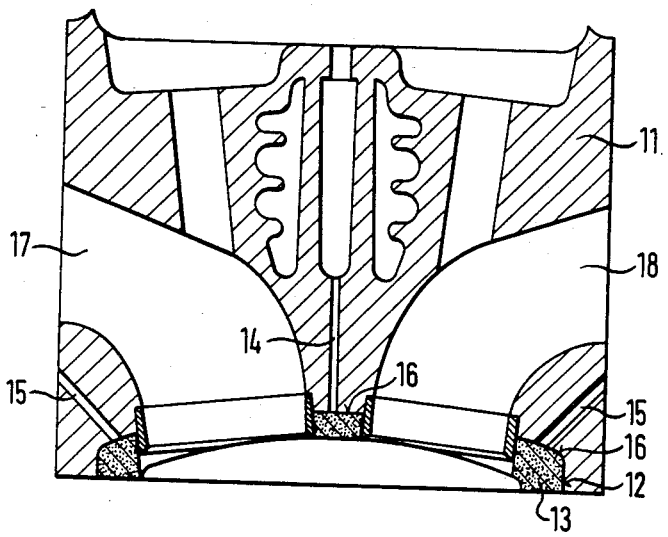

FIG. 2—a cylinder head designed according to the invention.

As shown in FIG. 1 an insert, here positioned by casting around, is arranged in a piston head recess 2 of a piston 1. In the base of the piston head recess 2 there are release bore holes 4 and 5 which lead from the joint face 6 between the insert part 3 and the piston head into the interior of the piston 1.

The bore hole 4 is centrally disposed and the bore holes 5 are eccentrally or peripherally concentrically arranged forming a ring of release bore holes.

FIG. 2 shows a component designed according to the invention, which is a cylinder head 11, having an insert 13 in a recess 12 facing the combustion chamber. Since the upwardly curved insert 13 has cut outs due to the arrangement of the inlet and outlet channels 17 and 18, in this case at least one central release bore hole 14 is provided venting the joint face 16. The peripheral release bore holes 15 lead from the joint face 16 to the surface of the cylinder head.

We claim:

1. A combustion chamber component for internal combustion engines comprising at least one insert of a heat resistant ceramic material, said insert being arranged in a recess in a basic material of the component facing said combustion chamber, and being bound free from axial pressing with the basic material of said component so as to form a joint face where respective surfaces of the insert and the recess meet, including means for venting pressure build-up occurring in the joint face during engine operation comprising a gas pressure release bore hole means (4,5 and 14,15) being provided in the basic material of said component (1,11) dimensioned so as to only act to lower gas pressure which builds up under said insert (3,13), said bore hole means (4,5 and 14,15) leading from one free surface of the component to where the surfaces of the insert and the recess (3;13) meet.

2. A component as in claim 1, wherein said release bore hole means comprising at least one hole which (4 and 14) is centrally arranged with respect to said insert (3;13).

3. A component as in claim 1, wherein said gas pressure release bore hole means comprises a plurality of release bore holes (5 and 15) being eccentrically arranged peripherally with respect to said insert (3;13).

4. A component as in claim 1, wherein said gas pressure release bore hole means comprises a plurality of release bore holes (4, 5 and 14, 15) and wherein the release bore holes (4, 5 and 14, 15) have a diameter of from 0.01 to 10 mm.

* * * * *